US008388775B2

(12) United States Patent
Poloni et al.

(10) Patent No.: US 8,388,775 B2
(45) Date of Patent: Mar. 5, 2013

(54) PROCESS OF THERMAL TREATMENT OF RAILS

(75) Inventors: Alfredo Poloni, Fogliano Redipuglia (IT); Nuredin Kapaj, Udine (IT); Andrea De Luca, Remanzacco (IT); Gianluca Bazzaro, Codroipo (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 139 days.

(21) Appl. No.: 12/734,797

(22) PCT Filed: Nov. 28, 2008

(86) PCT No.: PCT/EP2008/066426

§ 371 (c)(1), (2), (4) Date: May 25, 2010

(87) PCT Pub. No.: WO2009/068644

PCT Pub. Date: Jun. 4, 2009

(65) Prior Publication Data

US 2010/0300586 A1 Dec. 2, 2010

(30) Foreign Application Priority Data

Nov. 28, 2007 (IT) ..... MI2007A2244

(51) Int. Cl.
*C21D 9/04* (2006.01)

(52) U.S. Cl. ..... 148/581; 148/569; 148/658

(58) Field of Classification Search ..... 148/581–584, 148/569, 658; 266/114, 134
See application file for complete search history.

(56) References Cited

U.S. PATENT DOCUMENTS

| | | | | |
|---|---|---|---|---|
| 368,132 | A | 8/1887 | John Coffin | |
| 1,752,646 | A | 4/1930 | Lukascyzk | |
| 2,095,946 | A | 10/1937 | Blage | |
| 3,124,492 | A * | 3/1964 | Dewez, Jr. et al. | 148/569 |
| 4,668,308 | A | 5/1987 | Economopoulos et al. | |
| 5,004,510 | A | 4/1991 | Yu et al. | |
| 5,054,746 | A | 10/1991 | Buchegger | |
| 6,432,230 | B1 * | 8/2002 | Kock et al. | 148/646 |
| 2002/0134472 | A1 * | 9/2002 | Prskawetz et al. | 148/584 |

FOREIGN PATENT DOCUMENTS

| | | |
|---|---|---|
| DE | 10137596 | 2/2003 |
| DE | 10137596 A1 | 2/2003 |
| DE | 10148305 | 4/2003 |
| DE | 10148305 A1 | 4/2003 |
| EP | 1900830 | 3/2008 |
| EP | 1900830 A1 | 3/2008 |
| JP | 61003842 | 1/1986 |
| JP | 09057301 | 3/1997 |
| WO | 03028912 A2 | 4/2003 |
| WO | WO03028912 | 4/2003 |
| WO | WO 2008/077166 | 7/2008 |

* cited by examiner

*Primary Examiner* — Deborah Yee
(74) *Attorney, Agent, or Firm* — Stetina Brunda Garred & Brucker

(57) ABSTRACT

Process for the in-line thermal treatment of rolled rails which ensures to obtain a fine pearlitic structure which is uniform through a whole predetermined superficial thickness of the rail head. There is also disclosed a new device for the thermal treatment of rails in-line with a rolling system which, as compared to the known devices, is structurally much simpler, has a high sturdiness and requires less maintenance.

7 Claims, 7 Drawing Sheets

PROCESS OF THERMAL TREATMENT OF RAILS

FIELD OF THE INVENTION

The present invention relates to an in-line process for the thermal treatment of rolled rails for improving the mechanical properties in at least one superficial layer of the rail head, and to a device for the thermal treatment of rails, specifically to a device for the in-line thermal treatment of rails exiting from a rolling system.

STATE OF THE ART

Different solutions for devices and processes for the thermal treatment of rolled rails are included in the known art, the devices and processes specifically being directed to harden the head by means of the quenching operation.

Many of these devices are not arranged in-line with the rolling stands. This implies the stocking of the rolled rails and a subsequent heating thereof before proceeding to the quenching thermal treatment, with significant energy consumption and low efficiency.

In other systems the devices are instead arranged along the rolling line: the rolled rail is unloaded on a roller table, which is secured to the ground; it is then withdrawn by manipulators, including elaborate leverage systems, which control the handling of the rail during the thermal treatment to which the latter is subjected; and it is finally ejected on the cooling bed or plate by means of appropriate ejection mechanisms.

The rails which are heated or directly coming from the rolling mill are subjected to a fast cooling either by the use of spray nozzles, which inject a cooling fluid (water, air, or water mixed with air) on the rail head, or by immersion of the same in a tank containing a cooling fluid.

When spray nozzles are used, the drawback occurs of the rail warping in the direction of the length due to a temperature inhomogeneity in some segments of the rail and due to the subsequent different thermal dilatations.

When the immersion tank is used instead, a greater cooling uniformity in the direction of the length is achieved, although in any case the temperature difference between the base of the hot rail and the cooled head results in a bending of the rail; the drawback is that the manipulators employed are not sufficiently rigid and resistant to counteract and contain said bending. Another drawback of such manipulators is that, during the treatment, they are always in contact with the rail in the same fulcra thus generating undesirable "cold" areas on the rail itself.

Furthermore, with all of the known devices, the throughput of the entire line is extremely low. The throughput does not exceed 12-15 rails/hour for rails which are about 100 m long. Such devices are also not structurally simple and require a considerable maintenance, both elements determining an increase in production and management costs for the device.

The need is therefore felt to provide an innovative device for the thermal treatment of rails exiting from a rolling system allowing to overcome the above said drawbacks.

As far as the thermal treatment process is concerned, the immersion processes provide to make a continuous cooling of the rail head, which however results in a metallurgic structure which is not uniform through the entire thickness of the treated layer.

Other processes instead include the introduction of alloy elements, such as silicon and aluminium, in the steel to be treated in order to obtain the desired final features; the addition of alloying elements has the disadvantage of considerably increasing production costs.

The need is therefore felt to provide an innovative process for the thermal treatment of the head of the rails allowing to increase the mechanical properties through the achievement of an improved metallurgic structure without the addition of alloying elements in steel.

SUMMARY OF THE INVENTION

It is the primary object of the present invention to obtain a new process of in-line thermal treatment of rolled rails which ensures to obtain a fine pearlitic structure which is uniform through a whole predetermined superficial thickness of the rail head, specifically suitable for the use of the rails in very cold environments in virtue of the improved toughness.

Another object of the invention is to obtain a device for the thermal treatment of rails, placed in-line with a rolling system, which is structurally simple, has a high sturdiness and requires less maintenance as compared to the existing devices.

Therefore, the present invention aims to achieve the above disclosed objects by providing a process for in-line thermal treatment of a rail exiting from a rolling system which, according to claim 1, includes the following steps:

- a first cooling step in air of the rail until reaching a surface temperature of the rail head of at least 720° C.;
- a second cooling step by means of a cooling fluid until reaching a surface temperature of the rail head from 50 to 150° C. above the Ar3 temperature in order to avoid a phase transformation from austenite to pearlite;
- a third cooling step in air having a predetermined duration whereby the surface temperature is equalized up to the temperature of a superficial layer of the rail head, said superficial layer having a depth in the range between 15 and 25 mm from the surface;
- a fourth cooling step by means of a cooling fluid until reaching a surface temperature of the rail head lower than 500° C. whereby the phase transformation from austenite to pearlite occurs;

wherein said pearlite has an uniform structure with fine granulometry in said superficial layer.

Another aspect of the present invention provides to make a device for the in-line thermal treatment of rails exiting from a rolling system, which, according to claim 8, includes at least one mobile trolley in turn including

- a longitudinal roller table including pairs of rollers adapted to receive along the rolling axis a rail exiting from said system maintaining the rolling position thereof, said roller table being adapted to rotate about a longitudinal axis which is parallel to the rolling axis to orient the rail head downwards;
- and a longitudinal tank for containing a cooling fluid in which the rail head can be immersed.

Advantageously, the device of the invention includes at least one roller table allowing to guide the rail perfectly along the rolling line thus maintaining the same position with which it exits from the last rolling stand, i.e. with the symmetry axis of the rail in a substantially horizontal position. The same roller table also provides for the rigid support of the rail, the handling thereof during the thermal treatment and the unloading thereof on the cooling plate. The roller table of the device according to the invention therefore performs all of these functions in a different manner as compared to the traditional roller table which instead only serves to forward the rolled rail and therefore needs to be combined to dedicated manipulator devices.

A further advantage of the device of the invention is represented in that it provides two wheeled roller tables which, alternately and axially aligned to the rolling line, allow the almost concurrent thermal treatment of two rails improving the throughput of the system. In this manner, twice the throughput is achieved as compared to that achieved with the known devices, with a rolling rate in the range between 8 and 10 m/s.

Advantageously, immersing the rail in the tank for its whole length ensures the homogeneity of the treatment, the thermal distortions of the rail being virtually avoided or reduced to the minimum in virtue of the rigidity of the device, and also ensures a greater flexibility in the handling of the final cooling step, which is the most important to obtain the final desired structure. The result of a fine pearlitic grain depends on the cooling rate in this last step as well as on the deformation of the material obtained in the rolling stands. Therefore, high cooling rates are preferred, which do not lead in any case to the formation of undesired bainitic and/or bainitic-sorbitic structures.

The process according to the present invention advantageously provides four cooling steps, two by air and two by water with additives or by another appropriate cooling liquid. The head of the rails obtained by this process displays the following properties:

- a high hardness (340-420 HB);
- a high resistance to wear;
- a sufficient toughness;
- a high resistance to fatigue;
- a preservation of the above said mechanical properties at very low operating temperatures (up to −60° C.);
- a depth of the uniform fine pearlitic structure of at least 15-25 mm;
- a good surface quality and a good straightness of the rail at the end of the treatment;
- the absence of surface microcracks.

The dependent claims disclose preferred embodiments of the invention.

BRIEF DESCRIPTION OF THE DRAWINGS

Further features and advantages of the invention will become more apparent in light of the detailed description of a preferred though not exclusive embodiments of a device for the thermal treatment of rails, which is shown by way of non-limitative example with the aid of the accompanying drawings in which.

DETAILED DESCRIPTION OF PREFERRED EMBODIMENTS OF THE INVENTION

Figure 1A:
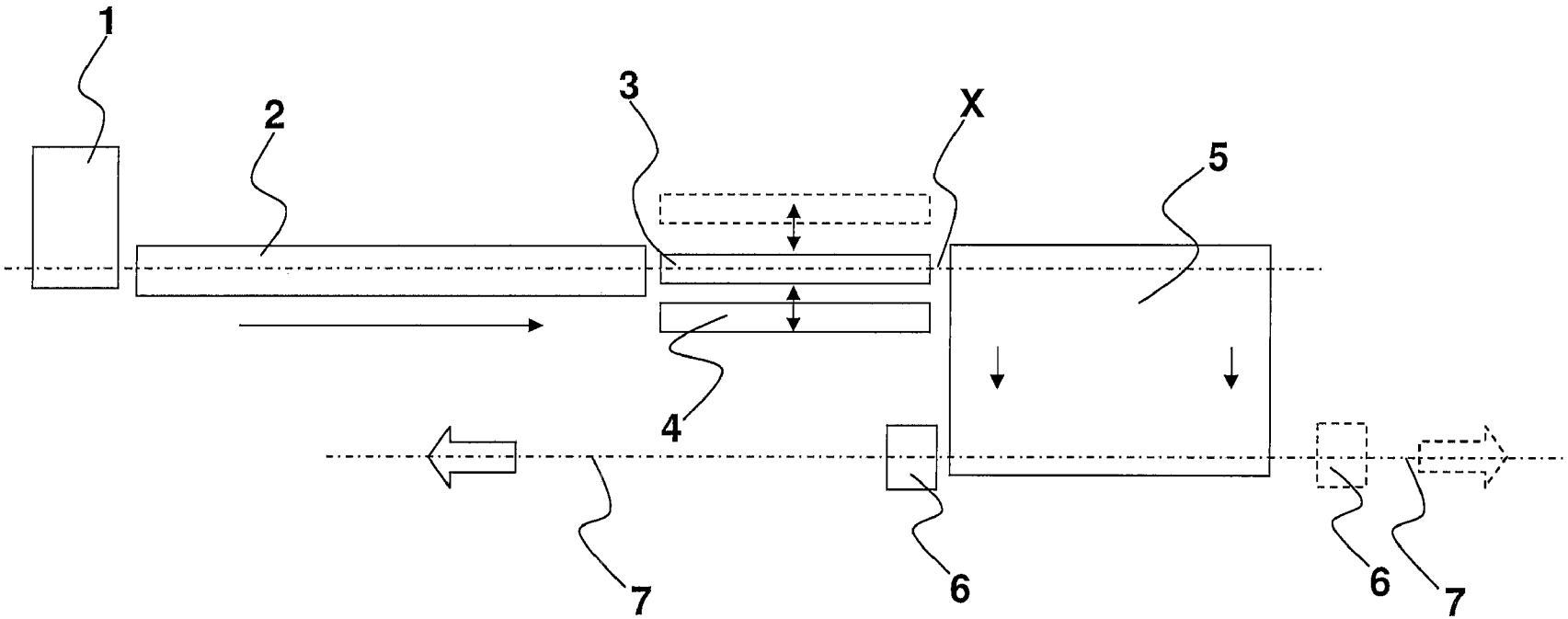
FIGS. 1*a* and 1*b* depict examples of layouts for rail production systems provided with the device according to the invention.

FIG. 1*a* depicts an example of the layout of a part of the rail production system including the device for the thermal treatment of the invention. This exemplary layout includes:

- a heating furnace 1 for billets;
- a billet rolling system 2 to obtain rails;
- two mobile trolleys 3, 4 each including a longitudinal roller table for forwarding, supporting and handling the rails during the thermal treatment;
- a cooling plate or bed 5, on which the treated rails are unloaded;
- a straightening machine 6, used to obtain the tolerances of straightness required by the market;
- an evacuation roller table 7 towards the stocking area.

The straightening machine 6 may be placed on the right and/or on the left of the cooling plate 5.

Figure 1B:
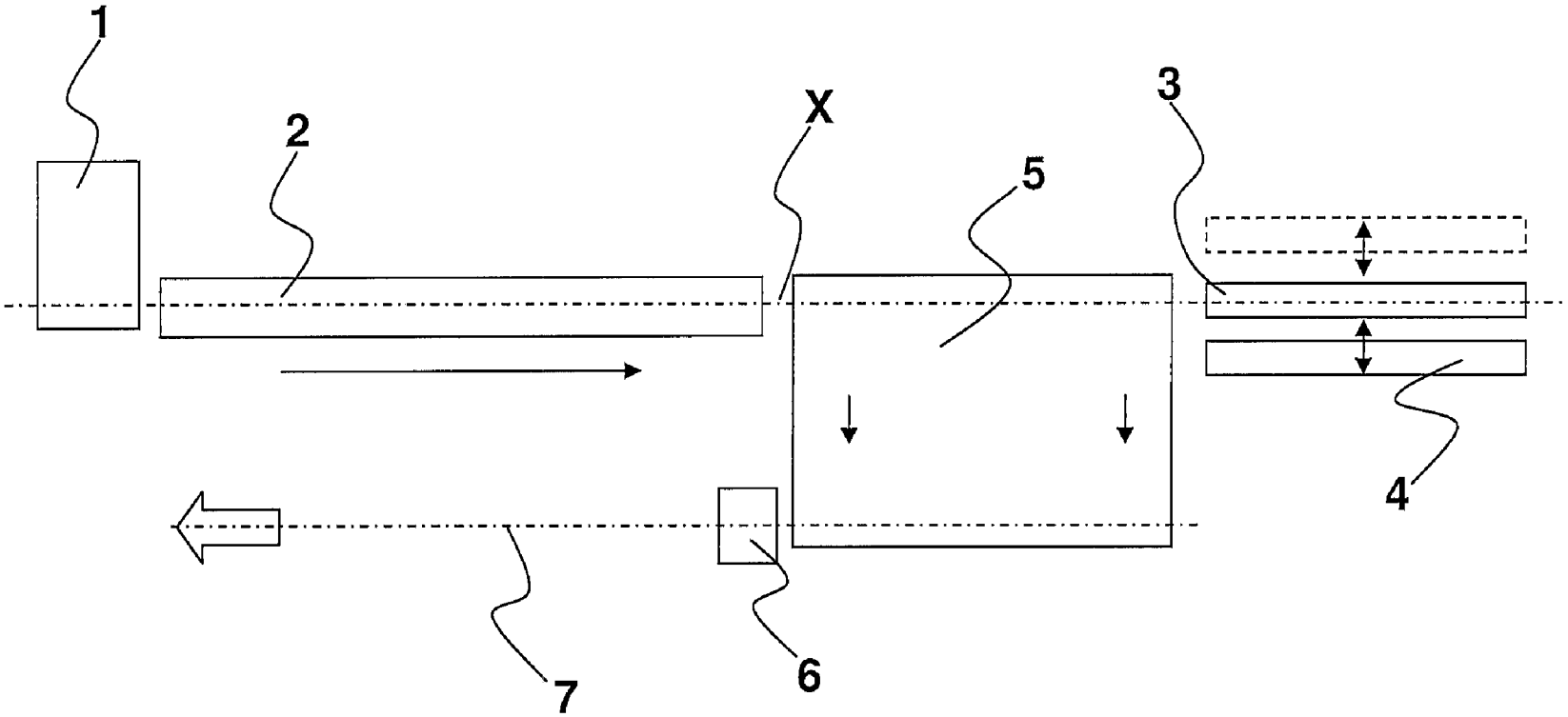

FIG. 1*b* depicts a variant of the layout in which the device for the thermal treatment of the invention, which includes the mobile trolleys 3 and 4, is always arranged along the rolling axis X although in this case the cooling plate 5 is arranged between the last rolling stand and the device of the invention. This layout offers the possibility to treat in-line only some of the rolled rails. The rolled rails, for which the quenching thermal treatment is not required, may be unloaded onto the plate 5 which, by translating them, unloads them directly on the straightening machine 6.

In the device of the invention the trolleys 3, 4 are arranged parallel to one another and to the rolling axis X and, advantageously, are adapted to be positioned alternately along said rolling axis. Each trolley has indeed the possibility to laterally translate with respect to the rolling axis or line in virtue of the presence of handling means, for instance a rack system provided in the floor or another appropriate system.

Figure 2:
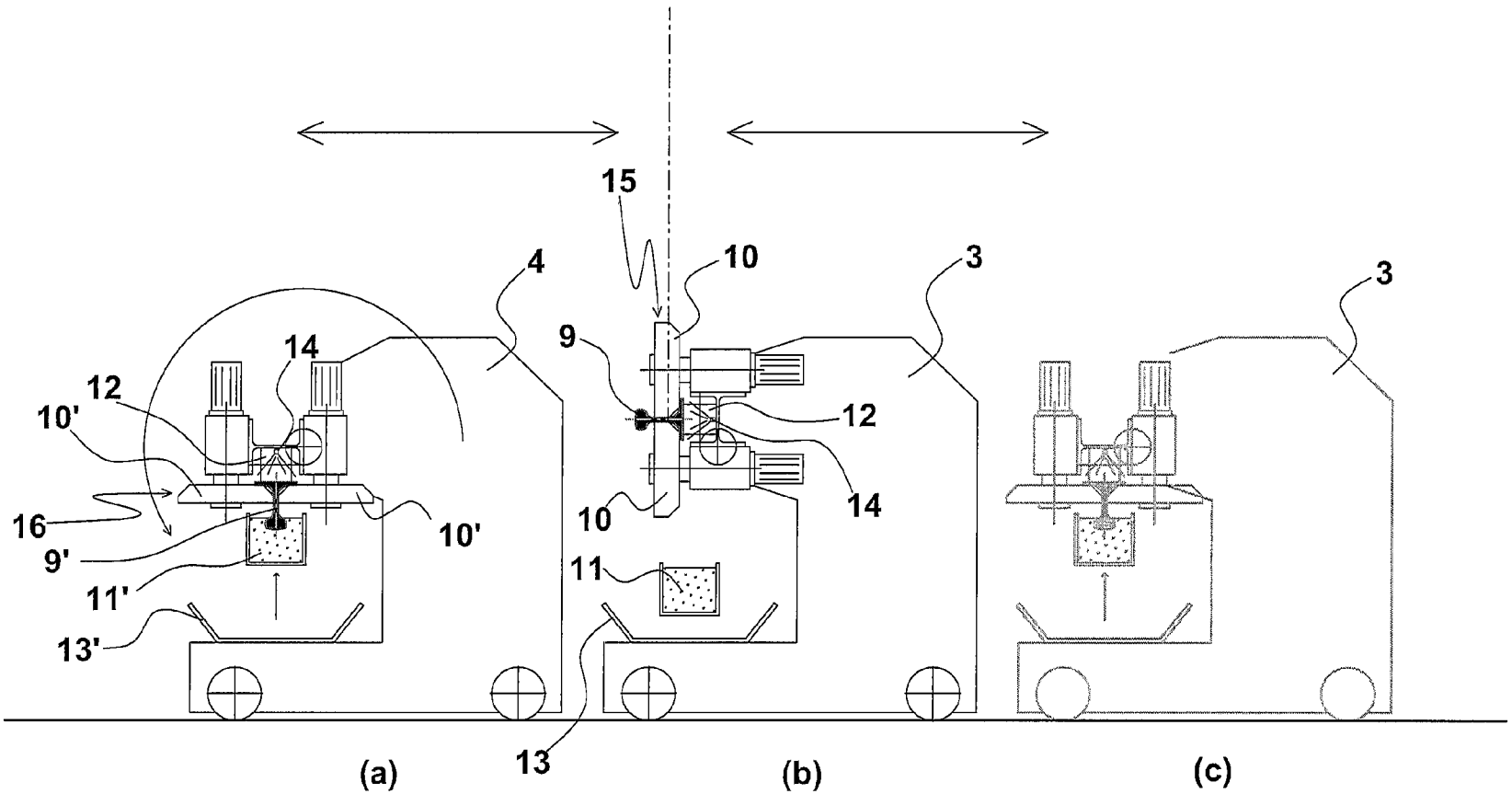
FIG. 2 depicts a side view of the device according to the invention.

Each trolley 3, 4, shown in FIG. 2, includes a longitudinal roller table 15, 16, in turn including roller pairs 10, 10', which are motorized and display a horizontal axis when the trolley is in the position (b), adapted to receive along the rolling axis X the rail 9, 9' exiting from the rolling system 2, thus holding it in the rolling position, i.e. the position with the horizontal symmetry axis. The roller pairs 10, 10' have a shaped profile to guide the rail 9, 9' to the web-foot junction area. These roller pairs 10, 10' may all be motorized or may be alternately motorized, for instance at intervals of one pair. Advantageously, in order to confer rigidity to the gripped rail and avoid undesired bending, the distance between each pair of rollers 10, 10' may be in the range between 0.5 and 2 m. The diameter of said rollers may instead be in the range between 400 and 600 mm.

The roller table, placed immediately at the exit of the rolling-mill train, serves to withdraw, guide and grip a rolled rail to perform the thermal treatment. At the end of the treatment, the rail is unloaded onto the cooling plate 5 by means of the same roller table.

For each pair of motorized rollers 10 there is provided also a idle roller 12, having vertical axis when the trolley is in the position (b), which comes into contact with the base of the rail foot to better guide the rail to the same position as that by which it exits from the last rolling stand.

In a preferred variant, the pairs of motorized rollers 10, 10' may be opened and, during the receiving step of a rolled rail to be treated, the lower rollers, fixed with the axis in a horizontal position, receive the rail while the upper rollers, which are mobile, are lifted from the working position. For instance, the upper rollers may be lifted by rotating about a pin to ease the insertion of the rail into the device of the invention. Once the rail is totally inserted, the upper rollers and the idle rollers 12 are respectively adhered to the web and to the foot of the rail to ensure the gripping.

Advantageously, the whole longitudinal roller table is appropriately pivoted so as to rotate about a longitudinal axis parallel to the rolling axis X to orient the rail head downwards.

Each trolley 3, 4 further includes a longitudinal tank 11, 11' containing a cooling liquid, preferably but not necessarily water containing a synthetic additive, such as for instance glycol, in which the rail head is immersed. The tank 11, 11' has a longitudinal extension at least equal to that of the rail and is placed on the base of the trolley.

Appropriate actuating means for the tank 11, 11' are provided to lift it from the base of the trolley up to a predetermined height so as to perform the immersion in the cooling liquid of the rail head. Such actuating means may include, for instance, hydraulic jacks or a leverage system. Advantageously, the thickness of the rollers 10, 10' is reduced, for instance in the range between 60 and 80 mm, so as to avoid interferences with the edge of the underlying cooling tank when the latter is lifted.

The level of the cooling liquid in the tank 11, 11' may be close to the edges or the liquid may overflow thus spilling laterally each time the rail is immersed. In this latter case, side collection tanks 13, 13' may be provided and, advantageously, recirculation means for the liquid may also be provided with the reintroduction in the tank of the collected liquid. Stirring means for stirring the cooling liquid in the tank, such as for instance oscillation generators, may also be provided.

Advantageously, spray nozzles 14 are provided on the roller tables 15, 16, which are intended to carry out the cooling of the rail foot in order to avoid thermal distortions as a consequence of the temperature difference which is generated between the head and the foot of the rail. A further advantage consists in that in this manner less residual stresses are obtained in the treated rail. The spray nozzles 14 preferably spray the same cooling liquid contained in the tank, possibly even mixed with air.

The already mentioned motorization of the roller pairs 10, 10' determines a longitudinal alternate motion of the rail which allows the dedicated nozzles 14 to cool the foot over its entire length and therefore also the part of foot in contact with the idle rollers 12.

The working cycle related to the preferred embodiment of the device of the invention, with two trolleys 3, 4 provided with respective roller tables 15, 16 is disclosed hereinafter:

1) the first trolley 3 is initially along the rolling axis X (position b in FIG. 2) and receives a first rail 9, for instance up to 150 m long and rolled from 8 to 10 m/sec. When the rail 9 is gripped in the roller table 15, it is not held still but it is continuously moved forwards and backwards so as to uniform the thermal load on the gripping rollers 10 and so as not to create cold spots on the web of the rail;

2) after having received the rolled rail 9, the first trolley 3 moves from the pass-line or rolling line (position b in FIG. 2) to the right (position c) while its roller table 15 rotates by 90° counter-clockwise so that the symmetry axis of the rail is oriented on the vertical with the head facing downwards; at the same time the second trolley 4 moves from its side position (position a) to the position along the rolling line (position b);

3) the air cooling of the rail 9 on the trolley 3 continues until reaching a temperature higher than 720° C., preferably in the range between 800 and 850° C., for a total time for instance in the range between 40 and 90 sec, preferably equal to 80 sec; at the same time, the second trolley 4 (position b) receives a second rail 9', which is also moved forwards and backwards so as to uniform the thermal load on the gripping rollers 10' and so as not to create cold spots on the web of the rail;

4) when the second rail 9' is received, the second trolley 4 returns to its side position (position a) while its roller table 16 rotates by 90° counter-clockwise so that the symmetry axis of the rail 9' is oriented on the vertical with the head facing downwards; at the same time, the first trolley 3 moves to return along the rolling line (position b) and its tank 11 is lifted by said actuating means (not shown), for instance hydraulic jacks, to perform a second cooling step by immersion of the head of the first rail 9 in the lifted tank 11. Advantageously, the above said longitudinal alternate motion of the rail 9 induces the vapour film, that tends to be formed in contact with the surface of the head during cooling, to brake when the head is immersed, thus improving the thermal exchange;

5) at the end of the time provided for the immersion step, for instance in the range between 10 and 20 sec, preferably equal to 15 sec, the tank 11 of the first trolley 3 (position b) is then lowered to perform the air equalizing step (having a duration for instance in the range between 10 and 60 seconds, preferably equal to 15 sec); at the same time, the first air cooling step of the second rail 9' (position a) is completed and the tank 11' of the second trolley 4 is lifted so as to perform the second cooling step by immersion of the head of the rail 9';

6) next, the tank 11' (position a) is then lowered to perform the air equalizing step (having a duration for instance in the range between 10 and 60 seconds, preferably equal to 15 sec) and the tank 11 (position b) is lifted again for a final cooling step by immersion of the head of the first rail 9 (having a duration for instance of about 250 sec);

7) similarly, the tank 11' (position a) is again lifted for the last cooling step by immersion of the head of the second rail 9';

8) when the last step of the thermal treatment for the first rail 9 is finished, the tank 11 (position b) is again lowered, the roller table 15 rotates by 90° in a direction opposite to the previous one to bring the symmetry axis of the rail back to a horizontal position, the motorized rollers 10 forward the thermally treated rail 9 by unloading it on the cooling plate 5 placed downstream and receive (step 1) a third rail to be treated when it exits from the last rolling stand;

9) when the third rail is received, the first trolley 3 repeats the operations described in steps 2) and 3) while in the second trolley 4, when the last thermal treatment step is finished for the second rail 9', the tank 11' (position a) is lowered again, the roller table 16 rotates by 90° in an opposite direction to the previous one to bring the symmetry axis of the rail back to a horizontal position while the same trolley 4 moves to return to the position aligned with the rolling line (position b), the motorized rollers 10' forward the second thermally treated rail 9' by unloading it onto the cooling plate 5 placed downstream and receive a fourth rail to be treated when it exits from the last rolling stand.

The cycle continues by repeating the above described steps 4 to 9. The rails 9, 9' are always loaded on and unloaded from the respective trolleys along the rolling axis X.

According to a variant, instead of lifting and lowering the tank 11, 11', it is possible to respectively provide the lowering and lifting of the roller table 15, 16, already being rotated by 90° counter-clockwise.

The process for the thermal treatment of rails for hardening the head, object of the present invention, comprising the four cooling steps above described, may also be performed by using devices different than that one described above.

In any case, the process according to the invention is performed in-line, i.e. at the exit of the rolling-mill train when the rail has reached the area of thermal treatment, so that the rolling residual temperature equal to about 900÷950° C. is exploited advantageously. In this manner, a considerable energy saving is obtained with respect to off-line processes which provide for heating the rail again before the quenching thermal treatment.

Hereinafter there is disclosed a preferred embodiment of the process according to the invention relating to a steel having a percentage of carbon in the range between 0.7 and 0.9% and a manganese content in the range between 0.75 and 1.25%.

At the exit from the rolling-mill train, when the rail has reached the thermal treatment area at the time t=0 (FIG. 3), all the rail is air-cooled until reaching a surface temperature of at least 720° C., preferably in the range between 800 and 850° C. This first air cooling step has a duration, for instance, in the range between 40 and 90 seconds, preferably equal to 80 sec. In this first step temperatures lower than 720° C. are avoided in order to have always a good margin for ensuring that no metallurgical transformation of the austenite occurs in the subsequent second cooling step.

Thus it is provided the second step of cooling of the only rail head by means of a cooling liquid, until reaching a surface temperature of the head little more above the Ar3 temperature of transformation from austenite into pearlite. Specifically, the value of this surface temperature is from 50 to 150° C. above the Ar3 temperature and thus such as to avoid the phase transformation from austenite into pearlite. This second step, having a duration for instance in the range between 10 and 20 seconds, preferably equal to 15 sec, may be performed by immersion of the rail head in a tank of water, or another appropriate liquid, eventually containing a synthetic additive, or may be performed by means of jets of water, or another appropriate liquid, eventually containing a synthetic additive, directed on the rail head and coming from dedicated nozzles provided in cooling boxes and arranged so as to cover the whole length of the rail.

Advantageously the process according to the invention provides to interrupt the cooling by means of said liquid and to carry out a third cooling step again in air, lasting for instance in the range between 10 and 60 seconds, preferably equal to 15 sec, in order to equalize the temperature of the rail head surface up to that one corresponding to a predetermined superficial layer of the rail head, having a depth preferably from 25 to 25 mm measured starting from said surface. Indeed the heat of the inner layers tempers the superficial layers up to a temperature of about 720÷840° C.

This third step may be performed by bringing the rail head out from the above mentioned tank or by closing the nozzles which generate the jets directed on the head.

Subsequently, there is provided a fourth cooling step, again by means of the same cooling liquid, until reaching a surface temperature lower than 500° C., preferably lower than 450° C. This fourth step, lasting for instance about 250 seconds, may be performed either by immersion of the rail head in said tank, or by means of the sprays of the above said nozzles of the cooling boxes.

The maximum duration of the fourth step is in the range between 180 and 350 seconds and it is such as to generate a cooling rate sufficiently high in order to obtain a fine grain pearlitic structure and avoid at the same time the formation of bainitic and bainitic-sorbitic structures, notoriously rigid but brittle. For the example of embodiment just described said cooling rate is not higher than 3-4° C./sec.

The total duration of the thermal treatment cycle, including all the four cooling steps, depends on the composition of the steel constituting the rail in terms of percentage of carbon (in the range between 0.45 and 1.2%) and of the alloy elements contained therein. The total time of the thermal treatment above disclosed is in the range, for instance, between 240 and 520 seconds, preferably equal to 360 seconds.

Further, the duration of the first three cooling steps also depends on the conditions in which the rail arrives from the exit of the rolling-mill train, such as the residual surface temperature and the condition of equalization of the temperature between the surface and the above mentioned superficial layer of the rail head. The duration of said first three steps can be also considerably reduced as much as the rail exits from the rolling mill with a relatively low temperature and with a good equalization condition of the temperature between the surface and the core of the rail head.

When the process is carried out by using the method of immersion in a tank of liquid, an advantageous embodiment according to the invention provides for:

- also cooling the base, or foot, of the rail by means of dedicated spray nozzles in order to avoid thermal distortions;
- alternately moving the rail forwards and backwards along the longitudinal axis to allow said dedicated nozzles both to uniformly cool the whole foot and to avoid the vapour film from remaining in contact with the head surface, when the head is immersed in the tank.

In the process according to the invention the fact of performing a first liquid cooling in which no phase transformation occurs, allows to reduce the total time of the rail head thermal treatment cycle; further the fact of interrupting the second cooling step by liquid and of performing the third step of cooling by air (tempering) allows to equalize, from the metallurgical point of view, the temperature of the above mentioned superficial layer of the rail head with the temperature of the external surface. In this manner, for the following fourth cooling step by means of liquid, there will occur about the same starting temperature of the austenite-pearlite phase transformation both for the surface and for all said superficial layer and, accordingly, about the same cooling rate. Therefore at the end of said phase transformation, a fine and uniform pearlitic structure is advantageously obtained in a superficial layer or thickness which is about 15-25 mm thick, preferably at least 20 mm. A fine and uniform pearlitic structure is required for operational use of the rail at very low temperatures, for instance up to −60° C.

Figure 3:
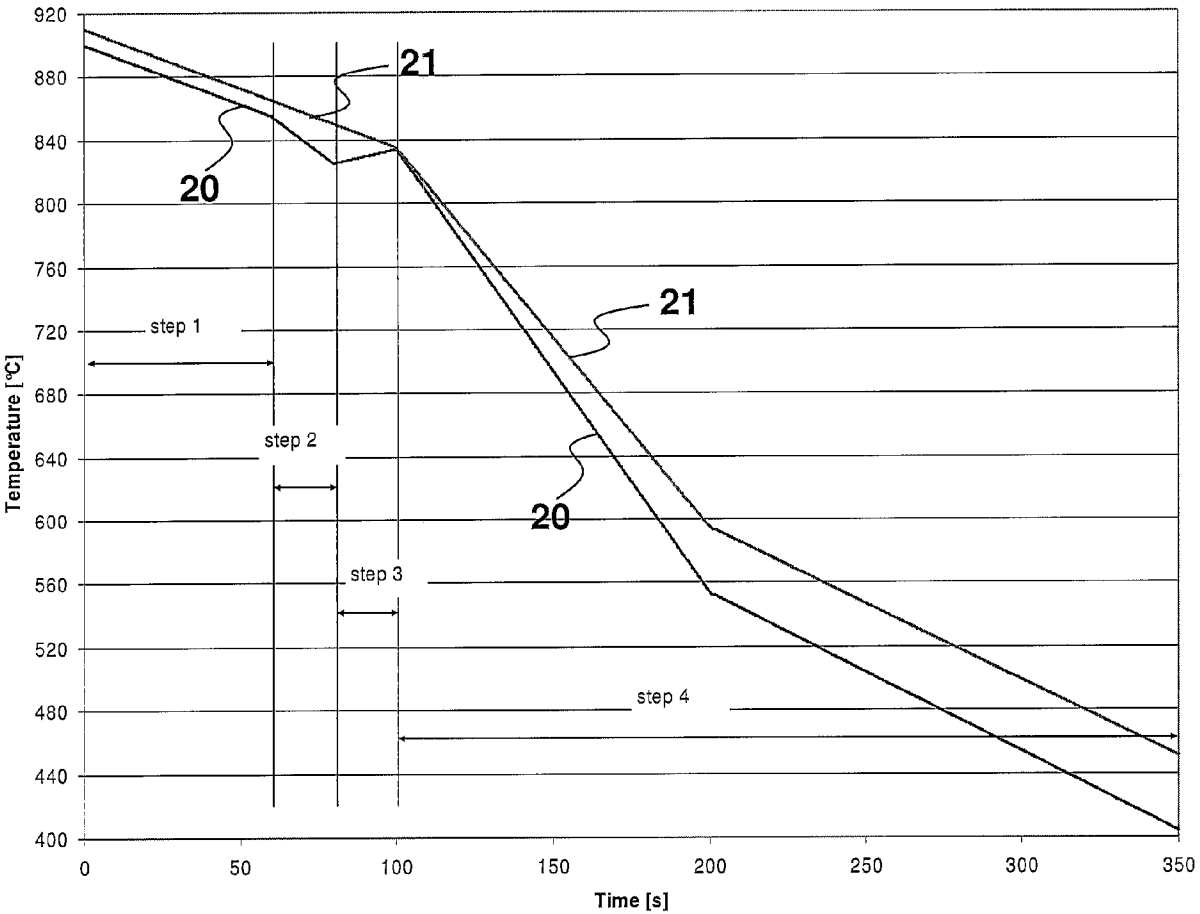
FIG. 3 depicts a diagram showing the trend of the temperature over time for some steps of the process according to the invention both on the surface and in correspondence with a predetermined superficial layer of the head of a rail.

FIG. 3 depicts a diagram which shows the trend of the temperature over time during the four cooling steps of the rail head (in air, in liquid, equalization in air, in liquid) both on the surface and in correspondence with an inner layer of the rail head having a thickness of 20 mm starting from said surface. The diagram relates to the process according to the invention which may be performed respectively by two variants of the device for the thermal treatment of rails:

- a variant which provides the immersion of the rail head in a tank of water, or another appropriate liquid, possibly containing a synthetic additive;
- and a variant which provides the production of jets of water with additives or of another appropriate liquid by means of spray nozzles, which are open or closed depending on the cooling step to be performed.

In the cooling step by immersion in the liquid it is possible to use water with the addition of an appropriate polymer at a temperature in the range between 35 and 55° C. or pure water at a temperature close to the boiling point.

Specifically, the curve 20 shows the trend of the surface temperature of the rail head, while the curve 21 shows the trend of the temperature of an inner layer, 20 mm thick, of the rail head. Both the curves 20, 21 include four segments corresponding respectively to the first, second, third and fourth cooling steps.

Figure 4:
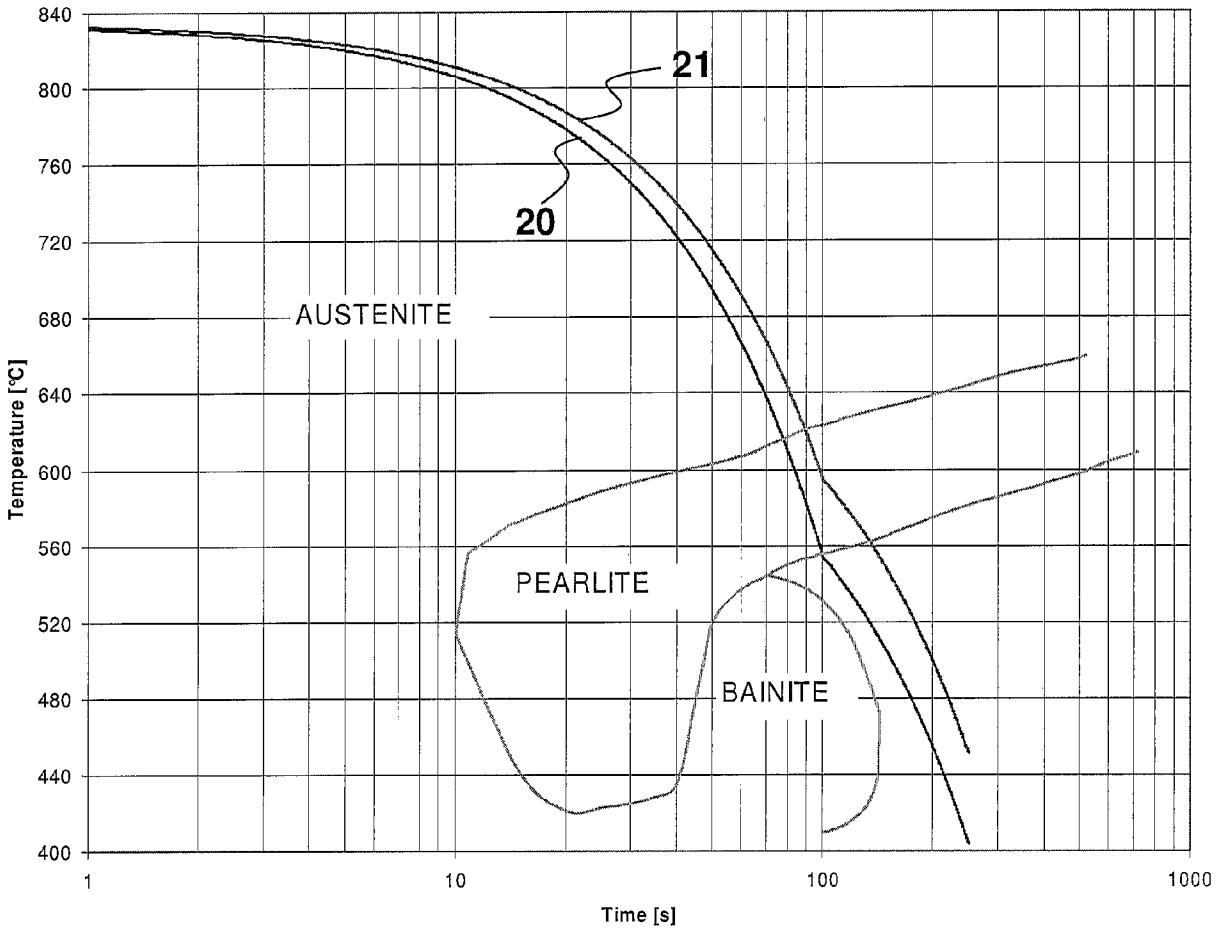
FIG. 4 depicts a diagram showing the trend of the temperature over time on a logarithmic scale for the final cooling step of the process according to the invention both on the surface and in correspondence with a predetermined superficial layer of the head of a rail; further the CCT or transformation curves are represented.

FIG. 4 depicts a diagram showing the trend of the temperature over time, on a logarithmic scale, during the last cooling step of the rail head. In the diagram also the CCT transformation curves, or Bain curves, are represented, which delimitate the regions of the following phases: austenite, pearlite, bainite. According to the present invention, in this only final cooling step the metallurgical transformation of the rail head is performed: indeed the curves 20 and 21 enter the pearlitic region represented by the CCT curves.

A high slope of the curves 20 and 21 in FIG. 4, i.e. a high cooling rate in the last step of the thermal treatment, is preferable in order to obtain a specially fine pearlitic grain, without however causing the formation of bainitic and/or bainitic-sorbitic structures. Specifically, according to the process of the present invention, the slope of the cooling curves 20 and 21 must be such as to pass close to the bainitic region without crossing it (FIG. 4).

Advantageously, the preferred cooling rate in the final step of the thermal treatment of the invention is in the range between 2 and 7° C./s, preferably 2÷5° C./s. In the example of a rail made of a steel having a percentage of carbon in the range between 0.7 and 0.9% and a manganese content in the range between 0.75 and 1.25% the optimal cooling rate is equal to 3÷4° C./s.

Advantageously, providing the intermediate third step of cooling in air (equalization in FIG. 3) allows the whole predetermined superficial layer of the rail head to have about the same temperature of the external surface, ensuring in this manner to obtain an uniform pearlitic structure, and thus uniform mechanical properties, along the whole thickness treated during the final cooling step by means of liquid.

Figure 5:
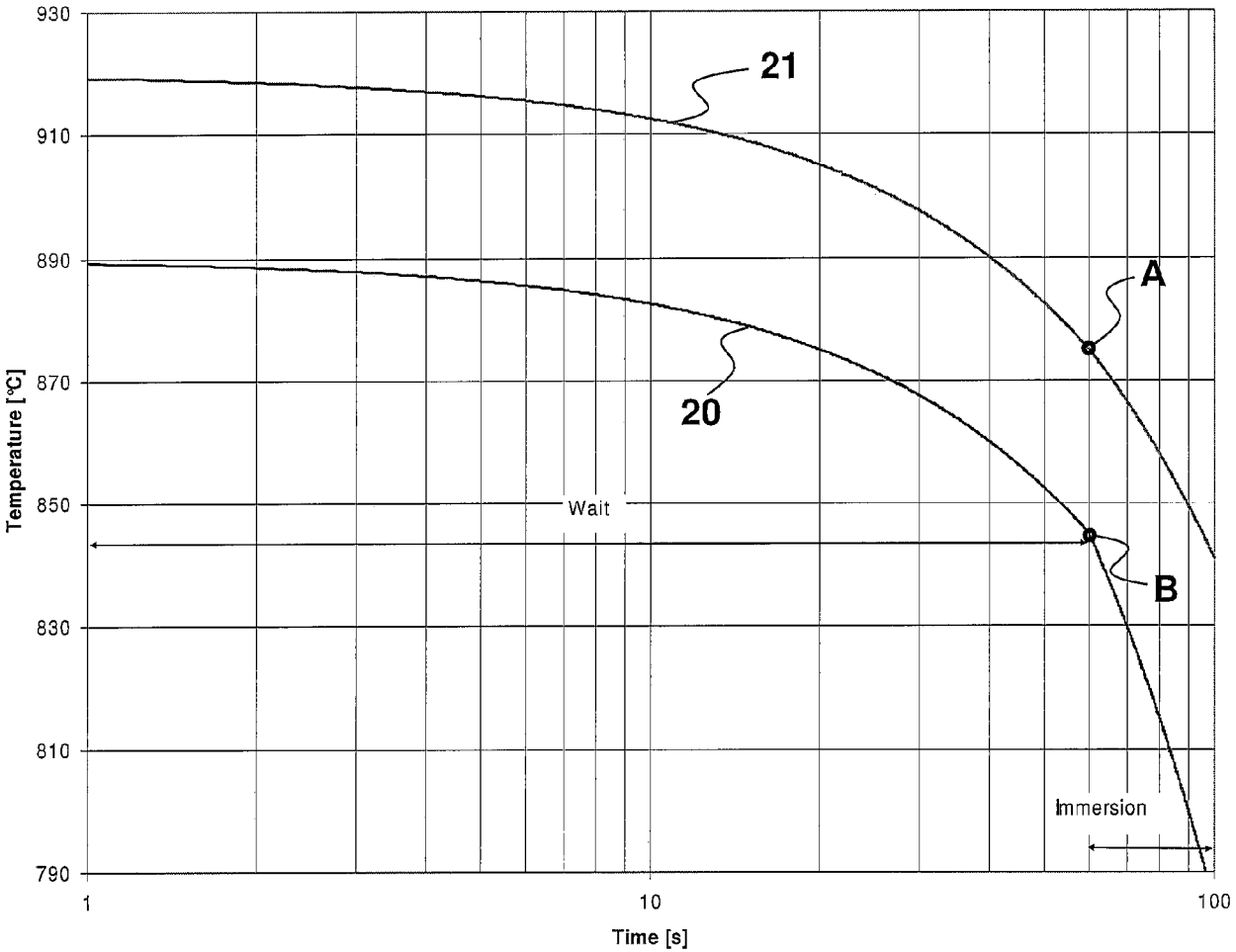
Fig. 5 PRIOR ART
FIG. 5 depicts a diagram showing the trend of the temperature over time in the single cooling step by immersion, provided in the known processes, both on the surface and in correspondence with a predetermined superficial layer of the head of a rail.
Figure 6:
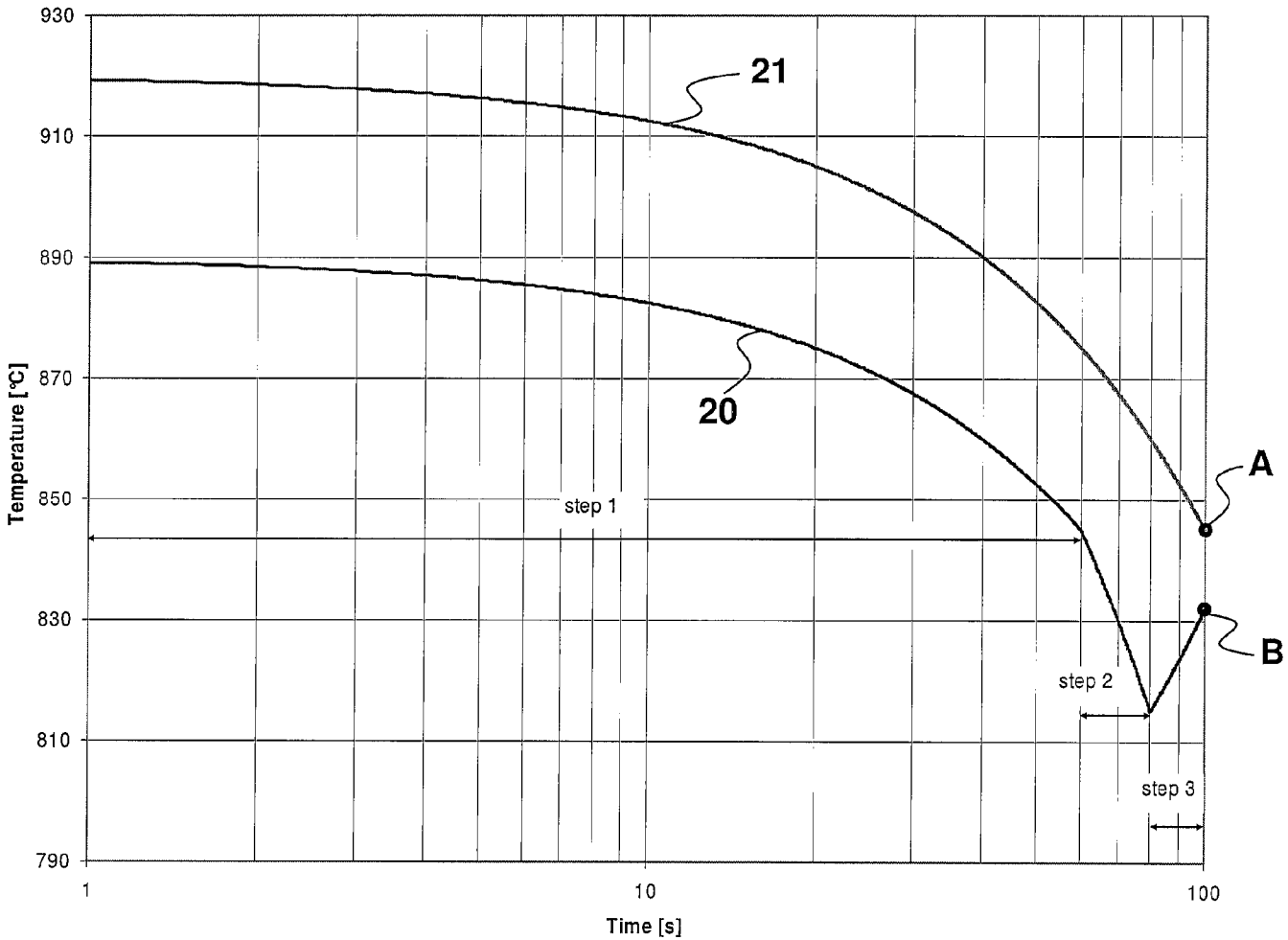
FIG. 6 depicts a temperature-time diagram showing the trend of the temperature in the first three cooling stages of the process of the invention both on the surface and in correspondence with a predetermined superficial layer of the head of a rail.

FIGS. 5 and 6 depict two temperature-time diagrams on logarithmic scale which respectively relate to:

- the known processes in which there is provided a single cooling step by immersion;
- the first three cooling stages of the process according to the invention. In the FIGS. 5 and 6 the curves indicated by reference numeral 20 represent the trend of the surface temperature of the rail head; the curves indicated by reference numeral 21 represent the trend of the temperature in a 20 mm thick inner layer of the rail head.

From the comparison, it may be noted that with the process according to the invention (FIG. 6), the temperature difference between the surface and said inner layer, before the cooling that causes the austenite-pearlite transformation (A and B points), is about three times lower than that obtainable with the known processes. In virtue of this latter aspect, the last cooling step allows to obtain the uniformity of the pearlitic structure, and thus the uniformity of the mechanical properties, in the whole above mentioned predetermined surface layer.

The invention claimed is:

1. A process for in-line thermal treatment of a rail, having a head, immediately at an exit of a rolling system wherein the rail has reached a rolling residual temperature in a range of about 900° C. to 950° C., the process including the following steps:

a first cooling step in air of the rail until reaching a surface temperature of the rail head of at least 720° C.;

a second step of cooling the rail head by a cooling fluid until reaching a surface temperature of the rail head from 50 to 150° C. above the Ar3 temperature in order to avoid a phase transformation from austenite to pearlite;

a third step of cooling the rail head in air whereby the heat of the inner layers tempers the superficial layers up to a temperature of 720-840° C. and the surface temperature is equalized up to the temperature of a superficial layer of the rail head, said superficial layer having a depth in the range between 15 and 25 mm from the surface;

a fourth step of cooling the rail head by a cooling fluid until reaching a surface temperature of the rail head lower than 500° C. whereby the phase transformation from austenite to pearlite occurs;

wherein said pearlite has an uniform structure with fine granulometry in said superficial layer whereby uniform mechanical properties are obtained along said superficial layer.

2. A process according to claim 1, wherein the cooling rate in said fourth cooling step is equal to about 2 to 7° C./sec.

3. A process according to claim 1, wherein the second and fourth cooling steps are carried out by an immersion of the rail head in a tank containing said cooling fluid.

4. A process according to claim 3, wherein the third cooling step is carried out by bringing the rail head out from said tank.

5. A process according to claim 1, wherein the second and fourth cooling steps are carried out by means of cooling fluid jets directed on the rail head and coming from dedicated nozzles arranged so as to cover the whole length of the rail.

6. A process according to claim 5, wherein the third cooling step is carried out by closing said nozzles.

7. A process for in-line thermal treatment of a rail, having a head, exiting from a rolling system wherein the rail has reached a rolling residual temperature in a range of about 900° C. to 950° C., the process including the following steps:

a first cooling step in air of the rail until reaching a surface temperature of the rail head of at least 720° C.;

a second step of cooling the rail head by an immersion of the rail head in a tank containing a cooling liquid until reaching a surface temperature of the rail head from 50 to 150° C. above the Ar3 temperature in order to avoid a phase transformation from austenite to pearlite;

a third step of cooling the rail head in air whereby the heat of the inner layers tempers the superficial layers up to a temperature of 720-840° C. and the surface temperature is equalized up to the temperature of a superficial layer of the rail head, said superficial layer having a depth in the range between 15 and 25 mm from the surface;

a fourth step of cooling the rail head by means of an immersion of the rail head in the tank containing the cooling liquid until reaching a surface temperature of the rail head lower than 500° C. whereby the phase transformation from austenite to pearlite occurs;

wherein said pearlite has an uniform structure with fine granulometry in said superficial layer whereby uniform mechanical properties are obtained along said superficial layer.

* * * * *